United States Patent [19]

Ray

[11] 4,077,591

[45] Mar. 7, 1978

[54] ELECTRIC SWITCH MACHINE FOR MODEL RAILROADS

[76] Inventor: Elmer C. Ray, 8810 Maryland Ave., Marmet, W. Va. 25315

[21] Appl. No.: 811,766

[22] Filed: Jun. 30, 1977

[51] Int. Cl.[2] ..... E01B 7/02

[52] U.S. Cl. ..... 246/415 A; 246/430; 246/431

[58] Field of Search ..... 246/333, 303, 405, 415 R, 246/415 A, 430, 431, 279, 393; 200/30 R, 31 R, 153 L, 153 LB; 104/130, 132; 74/569

[56] References Cited

U.S. PATENT DOCUMENTS

| | | | |
|---|---|---|---|
| 1,194,160 | 8/1916 | Fortescue | 200/30 R |
| 2,298,890 | 10/1942 | Leonard | 200/31 R |
| 2,615,125 | 10/1952 | Peabody | 246/415 A |

*Primary Examiner*—Trygve M. Blix
*Assistant Examiner*—Reinhard J. Eizenzopf

[57] ABSTRACT

This machine consists primarily of a low R.P.M., motor driven cam and follower, the follower being pivotally secured to the top of a table, upon which the railroad tracks are secured. The machine includes an adjustable push rod, secured to one leg of the follower, which will intermittently connect and disconnect a section of track with another track.

4 Claims, 2 Drawing Figures

ELECTRIC SWITCH MACHINE FOR MODEL RAILROADS

This invention relates to model railroads, and more particularly, to an electric switch machine for model railroads.

It is, therefore, the principal object of this invention to provide an electric switch machine for model railroads, which will intermittently connect and disconnect a section of railroad track with another railroad track.

Another object of this invention is to provide an electric switch machine for model railroads, which will have a cam and cam follower, with push-rod means secured to the follower, for moving a railroad track.

A further object of this invention is to provide an electric switch machine for model railroads of the type described, which will be mounted on top of the table having the railroad track thereon, but will be hidden from view, by means of a suitable model structure on the table.

Other objects of the invention are to provide an electric switch machine for model railroads, which is simple in design, inexpensive to manufacture, rugged in construction, easy to use and efficient in operation.

Figure 1:
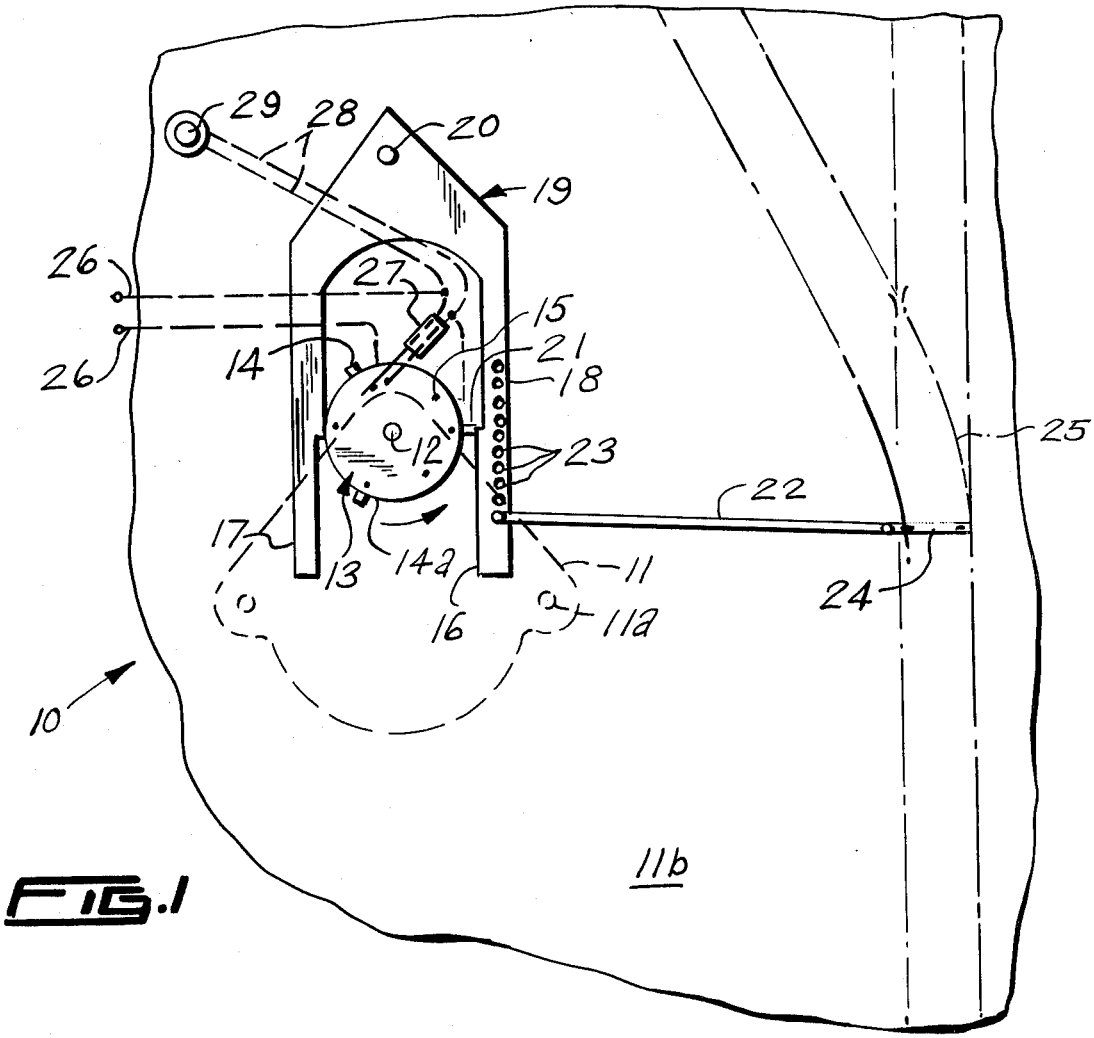
Figure 2:
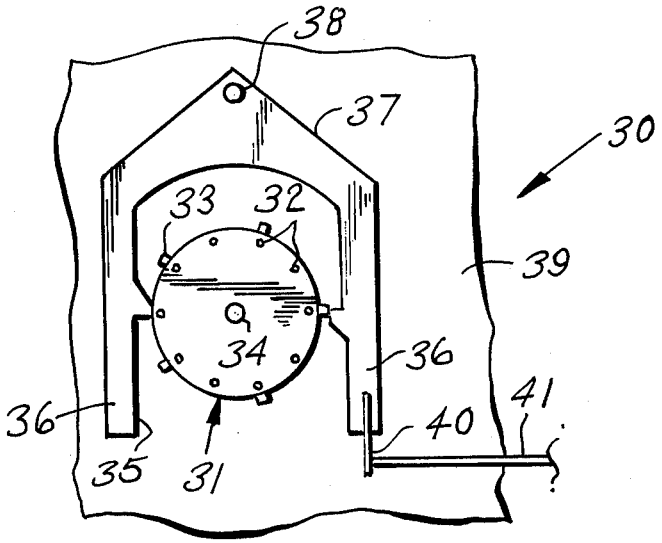

These, and other objects, will be readily evident, upon a study of the following specification, and the accompanying drawing, wherein;

FIG. 1 is a top plan view of the present invention, shown mounted to a table, the railroad tracks being shown in phantom lines; and FIG. 2 is a fragmentary top plan view of a modified form of the invention.

According to this invention, an electric switch machine for model railroads 10 is shown to include a one R.P.M. motor 11, which is secured by suitable fasteners 11*a* to the bottom of table 11*b*. The shaft 12 has secured, stationary thereto, a disc cam 13 which has a plurality of equally and radially spaced apart pins 14, that are fixedly secured to the outer periphery 14*a* of disc cam 13. A plurality of pins 15 are equally spaced apart, and are fixedly secured to the face of disc cam 13, for a purpose which hereinafter will be described. Disc cam 13 is disposed in the opening 16, defined by the legs 17 and 18 of pivotable cam follower 19, which is secured to the top of table 11*b*, by means of pin 20. Cam follower 19 has shoulders 21, in each of the legs 17 and 18, against which pins 14 will ride when machine 10 is in operation. A pushrod 22, adjustable in length in a well known manner, is pivotally secured in any one of the spaced apart openings 23, of leg 18, and the opposite end is pivotally secured in one end of track member 24, which is fixedly secured to rails 25, which will be moved by means of machine 10.

Electrical wires 26, of motor 11, are secured in a suitable manner to a power source. Micro-switch 27 is secured to table 11*b* at an angle with its contacts in position, so as to engage the pins 15. The wires 28, of micro-switch 27, are secured in series with starting switch 29. One of wires 28 connects with one of the terminals of motor 11, and the other wire 28 connects with a wire 26, which terminates at one side of micro-switch 27. Pushbutton starting switch 29 is used to activate machine 10, and micro-switch 27, is operated by a pin 15, to stop machine 10 when disc cam 13 has completed a cycle.

Referring now to FIG. 2 of the drawing, a modified machine 30 is shown to include a disc cam 31, having pins 32, in a similar manner as described of machine 10, with the exception, that there are more of them. Pins 33 are also greater in number than those of machine 10. Disc cam 31 is rotated by the motor shaft 34, and disc cam 31 is disposed within opening 35 defined by legs 36 of cam follower 37. Cam follower 37 is secured, by fastener 38, to the top of table 39, and one leg 36 has a spring 40 fixedly secured thereto, by one end, and the other end of spring 40 is fixedly secured to push-rod 41.

The operation of machine 30 is similar to that of machine 10, except for the spring 40 mounting.

While various changes may be made in the detail construction, it is understood that such changes will be within the spirit and scope of the present invention, as is defined by the appended claims.

What I now claim is:

1. An electric switch machine for model railroads, comprising a disc cam secured to a motor shaft, said disc cam having spaced apart pins on its face for opening and closing a micro-switch, and pin means on the outer periphery of said disc cam for pivoting a "U" shaped cam follower, and push-rod means secured to said cam follower, and to a fixed track member for intermittently engaging and disengaging a track from another track.

2. The combination according to claim 1, wherein said disc cam is stationary on said motor shaft, and said motor is secured stationary, by suitable fasteners, to the underside of the table to which the model railroad tracks are secured, and said disc cam is disposed between the legs of said "U" shaped cam follower, said legs of said cam follower having shoulders on their inner side edges, said shoulders being in sliding engagement with said pin means on the outer periphery of said disc cam, and said disc cam, when rotating, imparts a rocking pivotal motion to said cam follower, and pin means is secured to one end of said cam follower, and is fixedly secured and projecting from the top of said table.

3. The combination according to claim 2, wherein said micro-switch is fixedly secured to the top of said table within the opening defined by said legs of said cam follower, the contacts of said micro-switch being opened and closed by the pins extending from the face of said disc cam, and a push-button starting switch is wired to one side of said motor and is wired at its other side, to said micro-switch, and said push-rod means is secured at one end to an opening in one leg of said cam follower and is secured at its other end, in one end of said fixed track member, and said cam follower, when pivoted by said disc cam, urges said push-rod outwards, thus moving said track.

4. The combination according to claim 3, wherein said fixed track member is secured across the end of the arcuate portion of said track that is movable by means of said push-rod.

* * * * *